United States Patent [19]

Lee, Jr. et al.

[11] Patent Number: 4,515,284

[45] Date of Patent: May 7, 1985

[54] CAN BODY BOTTOM CONFIGURATION

[75] Inventors: Harry W. Lee, Jr.; Joseph W. Wallace, both of Richmond, Va.

[73] Assignee: Reynolds Metals Company, Richmond, Va.

[21] Appl. No.: 180,121

[22] Filed: Aug. 21, 1980

[51] Int. Cl.[3] ..... B65D 1/16; B65D 1/42; B65D 1/46

[52] U.S. Cl. ..... 220/70; 220/66

[58] Field of Search ..... 220/66, 70, 1 BC; 206/509; 215/1 C; 113/120 H

[56] References Cited

U.S. PATENT DOCUMENTS

| | | | |
|---|---|---|---|
| D. 248,544 | 7/1978 | Saunders | D9/3 |
| 2,423,708 | 7/1947 | Keogh et al. | 113/120 |
| 2,971,671 | 2/1961 | Shakman | 220/66 |
| 3,038,627 | 6/1962 | Daley | 220/3 |
| 3,409,167 | 11/1968 | Blanchard | 220/66 |
| 3,426,939 | 2/1969 | Young | 220/66 |
| 3,434,626 | 3/1969 | Kinslow, Jr. | 220/66 |
| 3,690,507 | 9/1972 | Gailus et al. | 220/66 |
| 3,693,828 | 9/1972 | Kneusel et al. | 220/66 |
| 3,701,455 | 10/1972 | Warnecke | 220/66 |
| 3,730,383 | 5/1973 | Dunn et al. | 220/66 |
| 3,760,751 | 9/1973 | Dunn et al. | 113/120 H |
| 3,789,785 | 2/1974 | Petit et al. | 113/1 G |
| 3,878,963 | 4/1975 | Knize | 220/66 |
| 3,904,069 | 9/1975 | Toukmanian | 220/66 |
| 3,905,507 | 9/1975 | Lyu | 220/66 |
| 3,942,673 | 3/1976 | Lyu et al. | 220/66 |
| 3,979,009 | 9/1976 | Walker | 220/66 |
| 3,989,159 | 11/1976 | Nixon et al. | 220/66 |
| 3,998,174 | 12/1976 | Saunders | 113/120 H |
| 4,048,934 | 9/1977 | Wallace | 113/120 H |
| 4,120,419 | 10/1978 | Saunders | 220/66 |
| 4,177,746 | 12/1978 | Lee, Jr. et al. | 113/120 H |
| 4,222,494 | 9/1980 | Lee, Jr. et al. | 220/66 |

FOREIGN PATENT DOCUMENTS

| | | | |
|---|---|---|---|
| 532675 | 11/1954 | Belgium | 220/66 |
| 969114 | 6/1975 | Canada | 220/70 |
| 992475 | 7/1976 | Canada | 220/70 |
| 35866 | 6/1925 | Denmark | 206/509 |
| 5025 | 10/1979 | European Pat. Off. | 220/70 |
| 2398669 | 3/1979 | France | 220/70 |
| 1456182 | 4/1974 | United Kingdom . | |
| 1395370 | 5/1975 | United Kingdom . | |
| 1575586 | 9/1980 | United Kingdom . | |

*Primary Examiner*—Allan N. Shoap
*Attorney, Agent, or Firm*—Alan T. McDonald

[57] ABSTRACT

A can body is disclosed which includes a bottom configuration designed to provide structural strength to the can body, thus permitting reductions in metal usage. The bottom configuration comprises three convex semi-torroidal portions which are connected to the sidewall of the can, a ring portion connected to the third convex semi-torroidal portion, a fourth convex semi-torroidal portion connected to the other end of the ring portion, an inwardly directed frustoconical portion connected to the other end of the ring portion, a concave semi-torroidal portion connected to the other end of the inwardly directed frustoconical portion and a bottom closing portion connected to the other end of the concave semi-torroidal portion.

27 Claims, 6 Drawing Figures

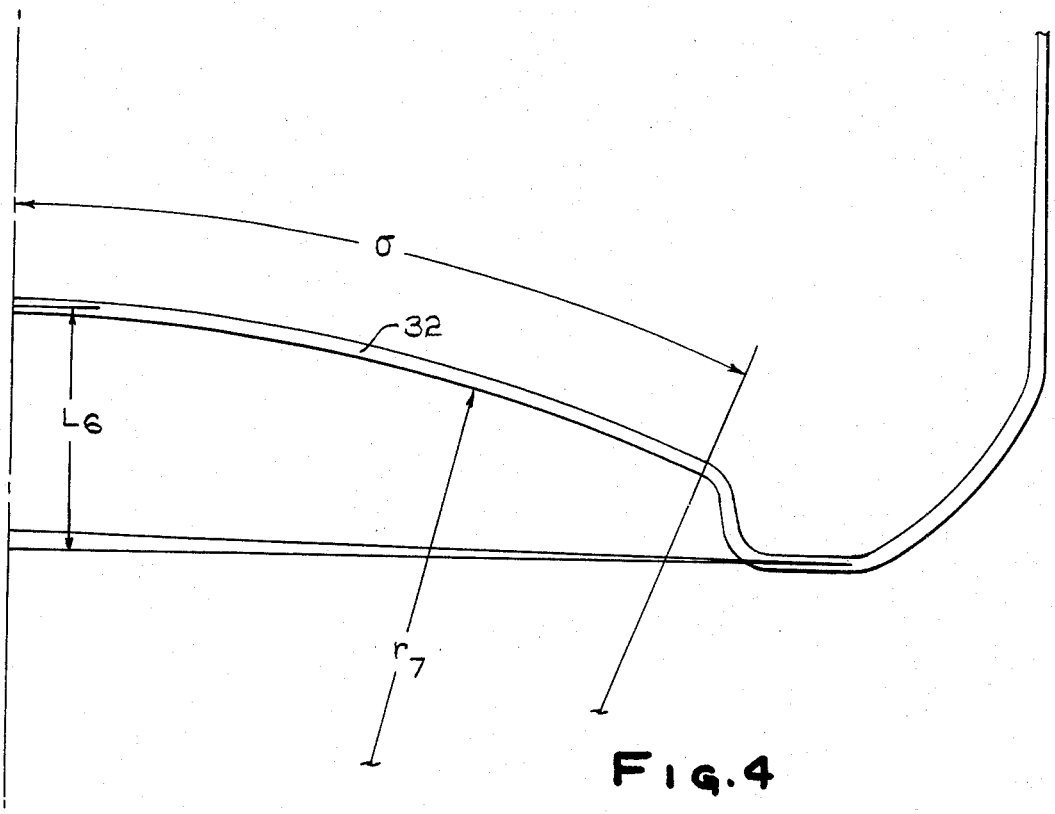
FIG. 4
FIG. 5
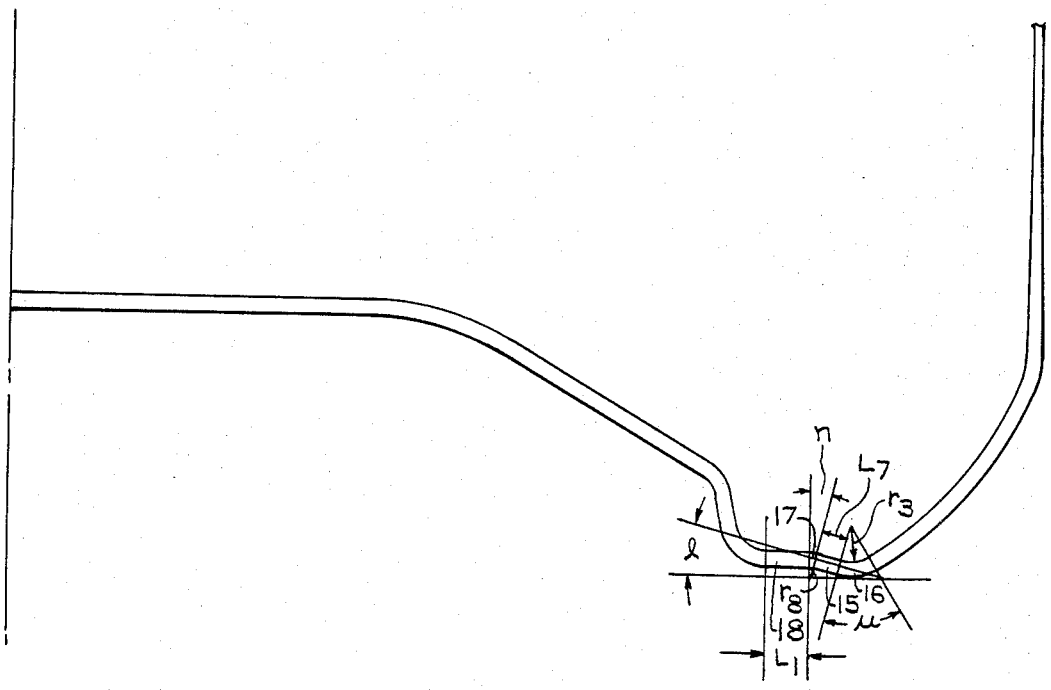

CAN BODY BOTTOM CONFIGURATION

BACKGROUND OF THE INVENTION

Metallic containers or cans have widespread use for the packaging of beverages, especially beer and soft drinks. Originally, these can bodies were produced from a tube which was formed from flat sheet steel, which tube was interlocked, soldered and/or welded along a side seam and included a first end member seamed to the tubular body prior to filling thereof and a second end member sealed thereto after filling thereof.

More recently, the three-piece can body previously described has been supplemented with the two-piece can body. In such a two-piece can body, a circular blank is cut from a metallic sheet. This blank is then drawn into a cup-like shape. The cup may then be redrawn into a final inside diameter. Whether or not the cup is redrawn, it is then ironed between a punch over which the cup is carried and one or more ironing dies, with the dies having a diameter slightly less than the outside diameter of the cup. This ironing produces a thinned and lengthened sidewall. Finally, the bottom of the now ironed can body contacts bottom forming tooling which, in cooperation with the end of the punch over which the can is carried, forms a bottom structure taking one of numerous forms. The completed can body then has a single end element seamed to its open end after filling.

As can easily be realized, while the major length of the sidewall of the can body has been thinned by the ironing process, the can bottom structure retains substantially the same wall thickness as the original sheet material from which the blank was formed. This bottom structure must withstand bulge pressures after filling and sealing of the can under the pressure provided by the beer or soft drink retained therein in excess of 90 lbs. per square inch (63279.0 kilograms per square meter). Additionally, this bottom structure must help provide column load strengh to the can body, which column load strengh must exceed 350 pounds (158.7 kilograms).

The weight of the metal employed to produce the can body is a substantial portion of its cost. These costs are reflected in direct metal costs, shipping costs and the like. Thus, it is desired to form can bodies to be as light as possible, while retaining the required strengh to prohibit failure of the can. Since a substantial portion of weight in a can body is in its bottom portion, and since the bottom portion is determined by its base structure and the thickness of the metal in this region, it is desired to form can bodies having base structures capable of withstanding the required bulge pressures and column load forces while using as thin a metal blank to form this can body as possible. Thus, it is a primary objective of the present invention to produce a can body having a bottom structure capable both of withstanding bulge pressures in excess of 90 lbs. per square inch (63279.0 kilograms per square meter) and column loads inn excess of 350 pounds (158.7 kilograms) while being formed of the thinnest possible sheet material.

An additional weight savings in forming a can body may result from the use of the smallest possible circular blank. A can body must have a specific height, with the height being determined by the volumetric capacity of the can being produced. The height of the sidewall is determined primarily by the amount of metal in the sidewall of the cup from which the can body is formed and by the amount or ironing to which the sidewall is subjected. However, reductions in the amount of metal necessary to form a required sidewall height can also be accomplished by producing a bottom structure which requires less total metal to be taken from the sidewall during its formation than previously required. In such cases, less metal from the sidewall is moved to the bottom structure when forming the bottom structure, thus reducing the height of the sidewall in a lesser amount than previously required. By controlling this metal movement, it is possible to produce a can body with the sidewall being somewhat shorter than previously necessary. This then permits the can body to be formed from a metal blank of somewhat smaller diameter than previously required, thus once again reducing the total metal usage for the can body and thus the cost of the can.

It is thus also a primary objective of the present invention to produce a can body having a bottom structure which requires less metal to be taken from the sidewall as it is formed than previous bottom structures.

THE PRESENT INVENTION

By means of the present invention, these desired results may be obtained.

The present invention comprises a can body having a sidewall and a bottom structure of a unique configuration. This bottom structure comprises a first convex semi-torroidal portion having one end thereof connected to the sidewall, a second convex semi-torroidal portion having one end thereof connected to the other end of the first convex semi-torroidal portion, a third convex semi-torroidal portion having one end thereof connected to the other end of the second convex semi-torroidal portion, a ring portion having one end thereof connected to the other end of the third convex semi-torroidal portion, a fourth convex semi-torroidal portion having one end thereof connected to the other end of the ring portion, a first inwardly directed frustoconical portion having one end thereof connected to the other end of the fourth convex semi-torroidal portion, a first concave semi-torroidal portion having one end thereof connected to the other end of the first inwardly directed frustoconical portion and a bottom closing structure connected to the other end of the first concave semi-torroidal portion. An additional inwardly directed frustoconical portion and an additional concave semi-torroidal portion may be interposed between the third convex semi-torroidal portion and the ring portion.

In one embodiment, the bottom closing structure comprises a second inwardly directed frustoconical portion having one end thereof connected to the other end of the first concave semi-torroidal portion, a second concave semi-torroidal portion having one end thereof connected to the other end of the second inwardly directed frustoconical portion and a disc portion connected to the other end of the second concave semi-torroidal portion.

In another embodiment, the bottom closing structure comprises a dome connected to the other end of the first concave semi-torroidal portion.

This bottom closing structure provides sufficient bulge and column load strength to permit use of relatively thin guage metal sheet in forming the can body while permitting adjustments in the volume of the can.

BRIEF DESCRIPTION OF THE DRAWINGS

The can body of the present invention will now be more fully described with reference to the drawings in which:

FIG. 4 is an expanded view of the sectioned portion of FIG. 3, with section lines omitted;

FIG. 5 is an expanded view illustrating a modified form of the bottom structure of the present invention, with section lines omitted;

DETAILED DESCRIPTION OF THE PREFERRED EMBODIMENTS

Figure 1:
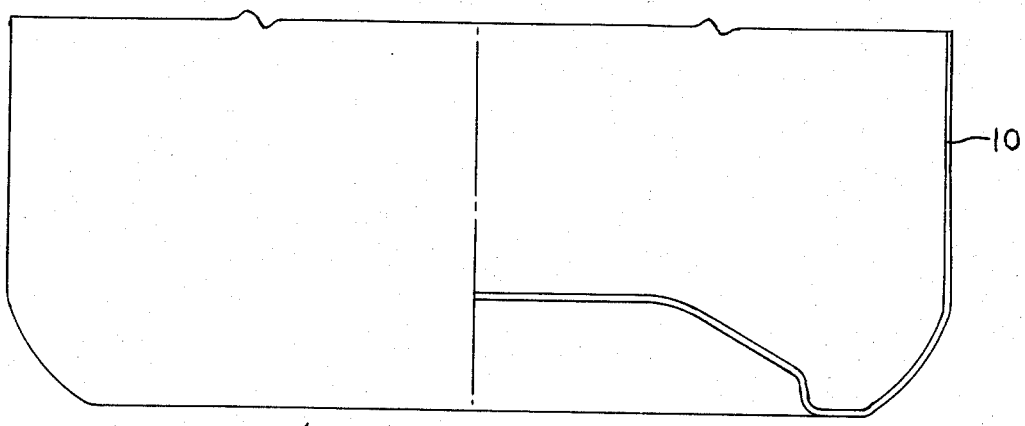
FIG. 1 is a fragmentary view, partially in section, illustrating a can body having a bottom structure according to a first embodiment of the present invention, with section lines omitted to avoid confusion.
Figure 2:
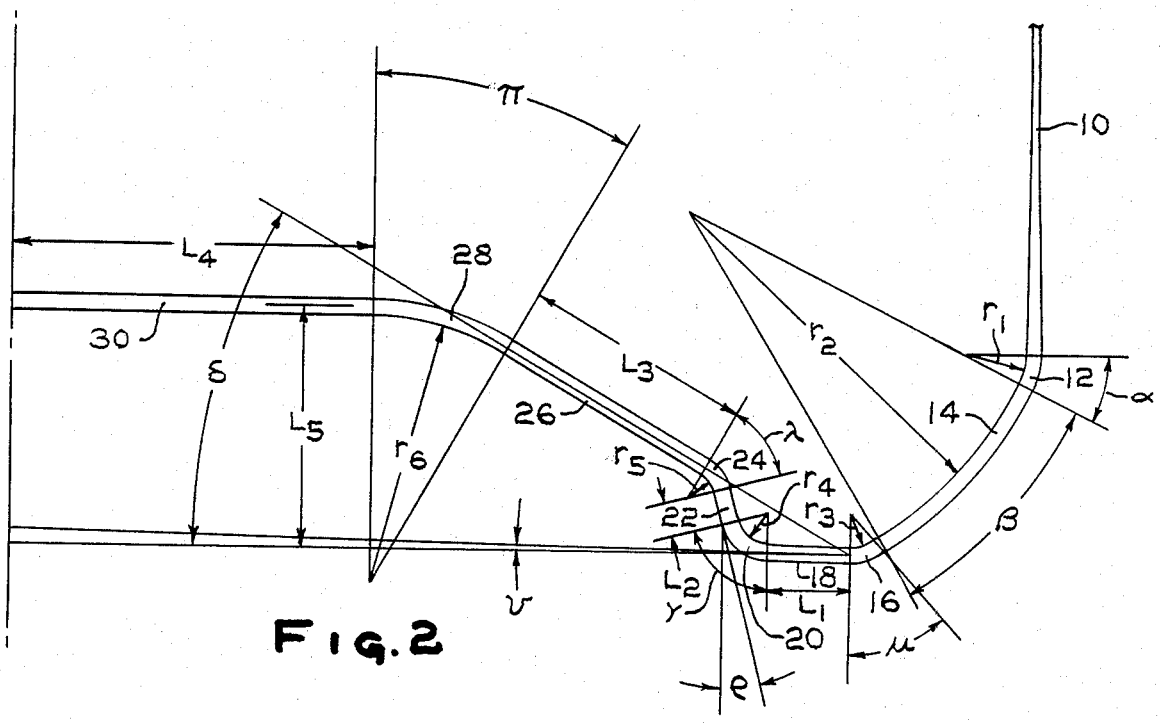
FIG. 2 is an expanded view of the sectioned portion of FIG. 1, illustrating the various elements comprising the bottom structure of the embodiment of FIG. 1, with section lines omitted to avoid confusion, in view of the many lines in the FIGURE.

Turning to FIGS. 1 and 2, a can body 1 is illustrated. The can body 1 has a sidewall 10. The sidewall 10 is of a pre-selected height determined by the volume of the can 1 being produced. As is known in the art, the sidewall 10 may be single, double or triple necked and flanged at its top opening to permit the can body 1 to receive a closing end element (not shown), which end element may include an easy-opening feature as a part thereof. The sidewall 10 is of somewhat varying thickness along its length, with the thickness at any point along its length being determined by the profile of the punch upon which the can body 1 was formed. Typically, the sidewall 10 has a thickness ranging between about 0.003 to 0.006 inches (0.007 to 0.015 centimeters). The formation of the sidewall 10 is well-known to those skilled in the art and thus need not be discussed in detail.

The bottom structure, however, forms the basis of the present invention. It is this bottom structure that will be described in detail.

A first convex semi-torroidal portion 12 is connected at one end thereof to the sidewall 10. This first convex semi-torroidal portion has a radius $r_1$, which radius $r_1$ may range between about 0.035 to 0.200 inches (0.089 to 0.508 centimeters), and preferably between about 0.075 to 0.125 inches (0.191 to 0.318 centimeters). The first convex semi-torroidal portion extends from the sidewall 10 for an angle $\alpha$, which angle $\alpha$ may range between about 15° to 30°, and preferably between about 20° to 25°.

Connected to the other end of the first convex semi-torroidal portion 12 is the first end of a second convex semi-torroidal portion 14. This second convex semi-torroidal portion 14 has a radius $r_2$, which radius $r_2$ may range between about 0.250 to 1.250 inches (0.635 to 3.175 centimeters), and preferably between about 0.300 to 0.700 inches (0.762 to 1.799 centimeters). The second convex semi-torroidal portion 14 extends from its junction with the first convex semi-torroidal portion 12 for an angle $\beta$, which angle $\beta$ may range between about 10° to 50°, and preferably between about 25° to 40°.

A third convex semi-torroidal portion 16 has its first end connected to the other end of the second convex semi-torroidal portion 14. This third convex semi-torroidal portion 16 has a radius $r_3$, which radius $r_3$ may range between about 0.020 to 0.080 inches (0.051 to 0.203 centimeters), and preferably between about 0.040 to 0.050 inches (0.102 to 0.127 centimeters). The third convex semi-torroidal portion 16 extends from its junction with the second convex semi-torroidal portion 14 for an angle $\mu$, which angle $\mu$ may range between about 10° to 65°, and preferably between about 25° to 35°.

Connected to the other end of the third convex semi-torroidal portion 16 is the first end of a ring portion 18. This ring portion 18 has a length $L_1$, which length $L_1$ may range between about 0.020 to 0.175 inches (0.051 to 0.445 centimeters), and preferably between about 0.060 to 0.120 inches (0.152 to 0.305 centimeters). From its junction with the third convex semi-torroidal portion 16, this ring portion 18 is positioned at an angle $\nu$ with respect to a horizontal plane upon which the can body 1 rests, which angle $\nu$ may range between about 0° to 10°, and preferably between about 1° to 3°.

It is important that the angle $\nu$ not be a negative angle, i.e. the ring portion 18 face downwardly into the horizontal plane upon which the can body 1 rests. Thus, a positive angle $\nu$, rather than a 0° angle $\nu$, is preferred. When such a positive angle $\nu$ is formed, the can body 1 will rest upon the junction between the third convex semi-torroidal portion 16 and the ring portion 18.

Connected to the other end of the ring portion 18 is the first end of a fourth convex semi-torroidal portion 20. This fourth convex semi-torroidal portion 20 has a radius $r_4$, which radius $r_4$ may range between about 0.020 to 0.080 inches (0.051 to 0.203 centimeters), and preferably between about 0.020 to 0.060 inches (0.051 to 0.152 centimeters). From its junction with the ring portion 18, the fourth convex semi-torroidal portion 20 extends for an angle $\gamma$, which angle $\gamma$ may range between about 55° to 88°, and preferably between about 70° to 87°.

Connected to the other end of the fourth convex semi-torroidal portion 20 is the first end of a first inwardly directed frustoconical portion 22. This first inwardly directed frustoconical portion 22 has a length $L_2$, which length $L_2$ may range between about 0.010 to 0.250 inches (0.025 to 0.635 centimeters), and preferably between about 0.010 to 0.110 inches (0.025 to 0.279 centimeters). From its junction with the fourth convex semi-torroidal portion 20, the first inwardly directed frustoconical portion 22 is positioned at an angle $\rho$ with respect to the vertical plane through the center line of the can body 1, which angle $\rho$ may range between about 0.5° to 30°, and preferably between about 2° to 17°.

The first inwardly directed frustoconical portion 22 is a key to the strength of the can bottom structure of the present invention. This portion acts as a stiffening support structure to restrict the tendency of the bottom closing portion to bulge outwardly under the pressure caused within filled and sealed can bodies from such materials as beer or soft drinks.

Connected to the other end of the first inwardly directed frustoconical portion 22 is the first end of a first concave semi-torroidal portion 24. This first concave semi-torroidal portion 24 has a radius $r_5$, which radius $r_5$ may range between about 0.020 to 0.080 inches (0.051 to 0.203 centimeters), and preferably between about 0.020 to 0.060 inches (0.051 to 0.152 centimeters). The first concave semi-torroidal portion 24 extends from its junction with the first inwardly directed frustoconical portion 22 for an angle λ, which angle λ may range between about 30° to 69.5°, and preferably between about 43° to 63°.

Figure 3:
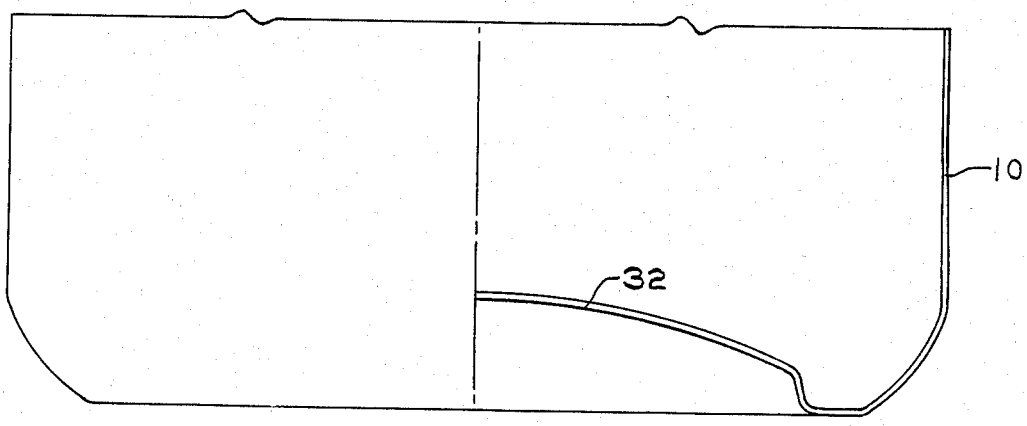
FIG. 3 is a fragmentary view, partially in section, illustrating a second embodiment of the bottom structure of the present invention, with section lines omitted.

The other end of the first conical semi-torroidal portion 24 is connected to a bottom closing portion. FIGS. 1 and 2 illustrate a first bottom closing portion for the can body 1 of the present invention and FIG. 3 illustrates a second bottom closing portion for the can body 1 of the present invention.

In FIG. 2, the first end of a second inwardly directed frustoconical portion 26 is connected to the other end of the first concave semi-torroidal portion 24. This second inwardly directed frustoconical portion 26 has a length $L_3$, which length $L_3$ may range between about 0.100 to 0.500 inches (0.254 to 1.270 centimeters), and preferably between about 0.250 to 0.350 inches (0.635 to 0.889 centimeters). The second inwardly directed frustoconical portion 26 is positioned at its junction with the first concave semi-torroidal portion 24 at an angle δ with respect to the horizontal plane upon which the can body 1 rests, which angle δ may range between about 20° to 35°, and preferably between about 25° to 30°.

Connected to the other end of the second inwardly directed frustoconical portion 26 is the first end of a second concave semi-torroidal portion 28. This second concave semi-torroidal portion 28 has a radius $r_6$, which radius $r_6$ may range between about 0.100 to 1.000 inches (0.254 to 2.540 centimeters), and preferably between about 0.300 to 0.400 inches (0.735 to 1.016 centimeters). The second concave semi-torroidal portion 28 extends from its junction with the second inwardly directed frustoconical portion 26 for an angle π, which angle π may range between about 20° to 35°, and preferably between about 25° to 30°.

Connected to the other end of the second concave semi-torroidal portion 28 is a bottom closing disc 30. This bottom closing disc 30 has a radius $L_4$, which radius $L_4$ may range between about 0.100 to 0.750 inches (0.254 to 1.905 centimeters), and preferably between about 0.300 to 0.500 inches (0.762 to 1.270 centimeters). The bottom closing disc 30 has a height $L_5$ perpendicular to the horizontal plane upon which the can body 1 rests. This height $L_5$ may range between about 0.200 to 0.400 inches (0.508 to 1.016 centimeters), and preferably between about 0.250 to 0.375 inches (0.635 to 0.953 centimeters).

Control of the height $L_5$ helps determine the final volume of the can, along with control of the length of the sidewall 10. Thus, adjustments may be made in the bottom forming tooling, as is common in the art, to adjust for punch wear and the like and maintain a constant volume can by adjusting the height $L_5$.

FIG. 3 illustrates a second bottom closing configuration for the bottom structure of the present invention. Connected to the end of the first concave semi-torroidal portion 24 opposite to the end of the first concave semi-torroidal portion 24 connected to the first inwardly directed frustoconical portion 22 is a concave dome 32. This concave dome 32 progresses to a maximum height $L_6$ perpendicular to the plane upon which the can body 1 rests, which height $L_6$ may range between about 0.250 to 0.500 inches (0.635 to 1.270 centimeters), and preferably between about 0.300 to 0.375 inches (0.762 to 0.953 centimeters). The radius $r_7$ of this concave dome 32 may range between about 1.500 to 5.000 inches (3.810 to 12.700 centimeters), and preferably between about 2.000 to 3.000 inches (5.080 to 7.620 centimeters), and the radius $r_7$ extends from its junction with the first concave semi-torroidal portion 24 for an angle σ, which angle σ may range between about 20° to 50°, and preferably between about 25° to 40°.

FIG. 4 illustrates a modified form for the can bottom structure of the present invention. In this embodiment, an additional inwardly directed frustoconical portion 15 and an additional concave semi-torroidal portion 17 are interposed between the third convex semi-torroidal portion 16 and the ring portion 18. In this embodiment, the can body 1 rests on the third semi-torroidal portion 16.

In this embodiment, a first end of the additional inwardly directed frustoconical portion 15 is connected to the other end of the third convex semi-torroidal portion 16. The angle μ of the third convex semi-torroidal portion 16 may now range between about 30° to 65°, and preferably between about 45° to 55°, in this embodiment. The additional inwardly directed frustoconical portion 15 has a length $L_7$, which length $L_7$ may range between about 0.000 to 0.100 inches (0.000 to 0.254 centimeters), and preferably between about 0.000 to 0.060 inches (0.000 to 0.152 centimeters). This additional inwardly directed frustoconical portion is positioned at an angle l with respect to a horizontal plane upon which the can body 1 rests, which angle l may range between about 5° to 50°, and preferably between about 10 to 30′.

Connected to the other end of this additional inwardly directed frustoconical portion 15 is the first end of an additional concave semi-torroidal portion 17. This additional concave semi-torroidal portion 17 has a radius $r_8$, which radius $r_8$ may range between about 0.005 to 0.060 inches (0.013 to 0.152 centimeters), and preferably between about 0.005 to 0.020 inches (0.013 to 0.051 centimeters). This additional concave semi-torroidal portion 17 extends from its junction with the additional inwardly directed frustoconical portion 15 to its junction with the ring portion 18 for an angle η, which angle η may range between about 10 to 30′, and preferably between about 15° to 25°.

Figure 6:
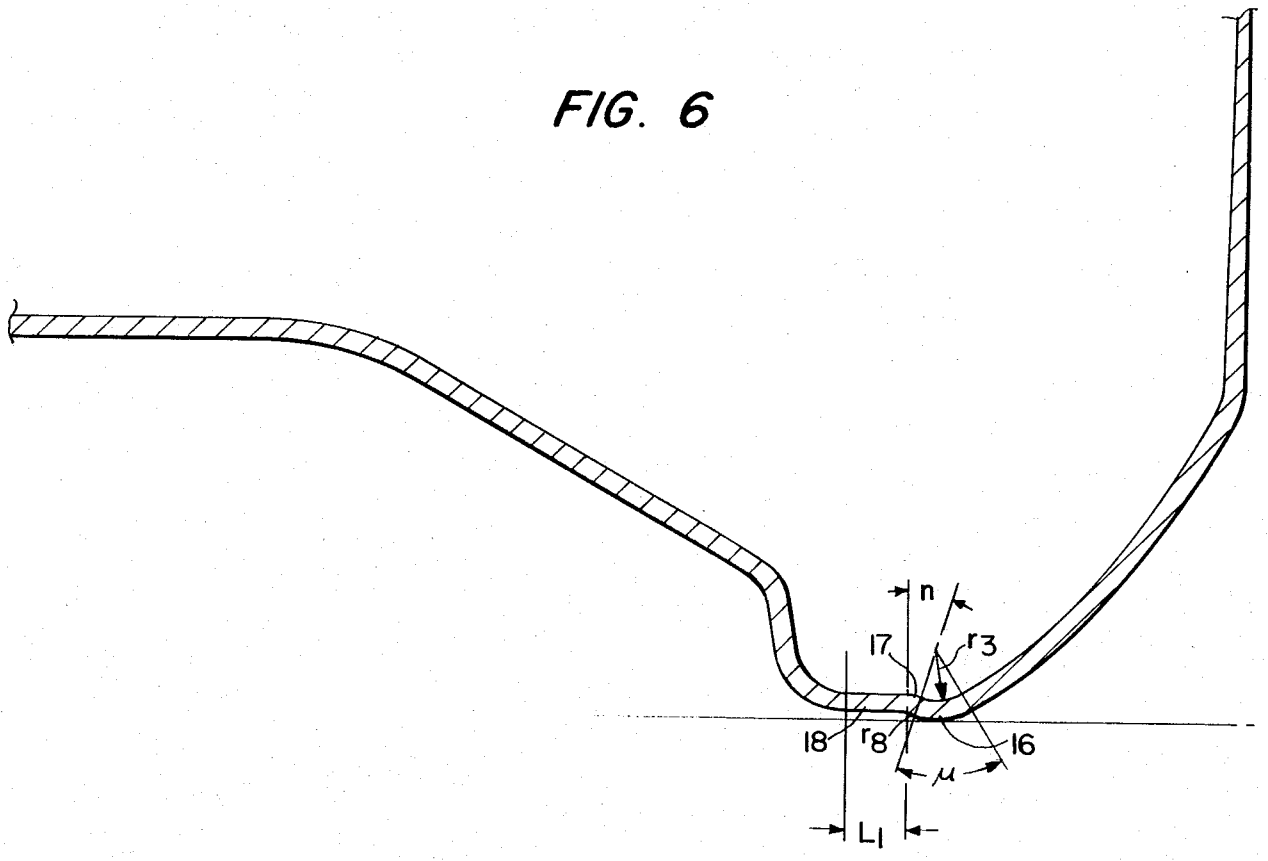
FIG. 6 is an expanded view, similar to FIG. 5, illustrating a modified form of the bottom structure of the present invention with length $L_7$ equal to 0.

As previously mentioned, the additional inwardly directed frustoconical portion 15 may have a length $L_7$ of 0.000 inches (0.000 centimeters), which means that this additional inwardly directed frustoconical portion 15 is not present, and that the additional concave semi-torroidal portion 17 is then itself connected to the other end of the third convex semi-torroidal portion 16. This embodiment is illustrated in FIG. 6.

This modified embodiment may be employed with the bottom closing structures illustrated in either FIG. 2 or FIG. 4.

EXAMPLE I

In accordance with the embodiment of FIGS. 1 and 2 of the present invention, can bodies having the present parameters were produced:

$r_1$ 0.125 inches (0.316 centimeters)
$r_2$ 0.500 inches (1.270 centimeters)
$r_3$ 0.045 inches (0.114 centimeters)
$r_4$ 0.040 inches (0.102 centimeters)
$r_5$ 0.040 inches (0.102 centimeters)
$r_6$ 0.340 inches (0.864 centimeters)
$L_1$ 0.096 inches (0.244 centimeters)
$L_2$ 0.030 inches (0.076 centimeters)
$L_3$ 0.286 inches (0.726 centimeters)
$L_4$ 0.456 inches (1.158 centimeters)
$L_5$ 0.290 inches (0.737 centimeters)

$\alpha$ 22°45′
$\beta$ 35°15′
$\mu$ 31°
$\nu$ 2°
$\gamma$ 88°
$\rho$ 5°45′
$\lambda$ 60°
$\pi$ 28°
$\delta$ 28°.

The cans were produced from aluminum blanks having a thickness of 0.0150 inches (0.0381 centimeters). The cans weighed 29.41 pounds (13.35 kilograms) per 1000 cans and had bulge pressures ranging between 96 to 98 pounds per square inch (67497.6 to 69803.8 kilograms per square meter) and column loads ranging between 375 to 400 pounds (170.25 to 181.60 kilograms).

EXAMPLE II

Can bodies similar to EXAMPLE I, but with the following modifications were produced:
$L_2$ 0.050 inches (0.127 centimeters)
$L_5$ 0.310 inches (0.787 centimeters)

These can bodies were produced from aluminum blanks having a thickness of 0.0141 inches (0.0358 centimeters). The cans weighted 29.09 pounds (13.21 kilograms) per 1000 cans and again had bulge pressures ranging between 96 to 98 pounds per square inch (67497.6 to 69803.8 kilograms per square meter) and column loads ranging between 375 to 400 pounds (170.25 to 181.60 kilograms).

EXAMPLE III

Can bodies again similar to EXAMPLE I, but with the following modifications were produced:
$L_2$ 0.075 inches (0.191 centimeters)
$L_5$ 0.335 inches (0.851 centimeters)

These can bodies were produced from aluminum blanks having a thickness of 0.0130 inches (0.0330 centimeters). The cans weighed 28.69 pounds (13.03 kilograms) per 1000 cans and once again had bulge pressures ranging between 96 to 98 pounds per square inch (67497.6 to 69803.8 kilograms per square meter) and column loads ranging between 375 to 400 pounds (170.25 to 181.60 kilograms).

EXAMPLE IV

Commercially available can bodies were formed according to the teachings of U.S. Pat. No. 4,177,746, which patent is assigned to the assignee of the present invention and the disclosure of which is hereby incorporated herein by reference. These can bodies were formed from aluminum blanks having a thickness of 0.0139 inches (0.0353 centimeters). The cans weighted 29.96 pounds (13.60 kilograms) per 1000 cans and, as in the above EXAMPLES, had bulge pressures ranging between 96 to 98 pounds per square inch (67497.6 to 68903.8 kilograms per square meter) and column loads ranging between 375 to 400 pounds (170.25 to 181.60 kilograms).

It can readily be seen from comparing EXAMPLES 3 to 4 that cans of equal strength to commercial cans may be produced when employing the bottom structures of the present invention from thinner metal blanks than previously employed, thus resulting in metal cost savings. In fact, as shown when comparing EXAMPLES 1, 2 and 4, can bodies formed from thicker metal blanks than commercially produced may be employed in the present invention while still realizing reduced metal usage, and thus reduced metal costs.

From the foregoing, it is clear that the present invention provides a can body structure which is both strong and lightweight.

While presently preferred embodiments of the present invention have been illustrated and described, it will be understood that the invention may be otherwise variously embodied and practiced within the scope of the following claims.

We claim:

1. In a metallic can body comprising a sidewall and a bottom closing structure, the improvement wherein said bottom closing structure comprises a first semi-torroidal portion having one end thereof directly attached to said sidewall, said first semi-torroidal portion being convex with respect to the exterior of said can body and having a radius $r_1$ and an angle $\alpha$; a second semi-torroidal portion having one end thereof directly attached to the other end of said first semi-torroidal portion, said second semi-torroidal portion being convex with respect to the exterior of said can body and having a radius $r_2$ and an angle $\beta$, $r_2$ being greater than $r_1$; a third semi-torroidal portion having one end thereof directly attached to the other end of said second semi-torroidal portion, said third semi-torroidal portion being convex with respect to the exterior of said can body and having a radius $r_3$ and an angle $\mu$, $r_3$ being less than $r_2$; a ring portion upon which said can body rests having one end thereof directly attached to the other end of said third semi-torroidal portion, said ring portion having a length $L_1$, said length $L_1$ ranging between about 0.020 to 0.175 inches (0.051 to 0.445 centimeters), and said ring portion being radially inwardly directed with respect to the exterior of said can body at an angle $\nu$; a fourth semi-torroidal portion having one end thereof directly attached to the other end of said ring portion, said forth semi-torroidal portion being convex with respect to the exterior of said can body and having a radius $r_4$ and an angle $\gamma$; a first frustoconical portion having one end thereof directly attached to the other end of said fourth semi-torroidal portion, said first frustoconical portion being radially inwardly directed with respect to the exterior of said can body and having a length $L_2$ and an angle $\rho$; a fifth semi-torroidal portion having one end thereof directly attached to the other end of said first frustoconical portion, said fifth semi-torroidal portion being concave with respect to the exterior of said can body and having a radius $r_5$ and an angle $\lambda$; and a bottom closing portion directly attached to the other end of said fifth semi-torroidal portion.

2. The can body of claim 1 wherein:

$r_1$ ranges between about 0.035 to 0.200 inches (0.089 to 0.508 centimeters);
$r_2$ ranges between about 0.250 to 1.250 inches (0.635 to 3.175 centimeters);
$r_3$ ranges between about 0.020 to 0.080 inches (0.051 to 0.203 centimeters);
$r_4$ ranges between about 0.020 to 0.080 inches (0.051 to 0.203 centimeters);
$r_5$ ranges between about 0.020 to 0.080 inches (0.051 to 0.203 centimeters);
$L_1$ ranges between about 0.020 to 0.175 inches (0.051 to 0.445 centimeters);
$L_2$ ranges between about 0.010 to 0.250 inches (0.025 to 0.635 centimeters);
$\alpha$ ranges between about 15° to 30°;
$\beta$ ranges between about 10° to 50°;

$\mu$ ranges between about 10° to 65°;
$\nu$ ranges between about 0° to 10°;
$\gamma$ ranges between about 55° to 88°;
$\rho$ ranges between about 0.5° to 30°; and
$\lambda$ ranges between about 30° to 69.5°.

3. The can body of claim 2 wherein:
$r_1$ ranges between about 0.075 to 0.125 inches (0.191 to 0.318 centimeters);
$r_2$ ranges between about 0.030 to 0.700 inches (0.762 to 1.799 centimeters);
$r_3$ ranges between about 0.040 to 0.050 inches (0.102 to 0.127 centimeters);
$r_4$ ranges between about 0.020 to 0.060 inches (0.051 to 0.152 centimeters);
$r_5$ ranges between about 0.020 to 0.060 inches (0.051 to 0.152 centimeters);
$L_1$ ranges between about 0.060 to 0.120 inches (0.152 to 0.305 centimeters);
$L_2$ ranges between about 0.010 to 0.110 inches (0.025 to 0.279 centimeters);
$\alpha$ ranges between about 20° to 25°;
$\beta$ ranges between about 25° to 40°;
$\mu$ ranges between about 25° to 35°;
$\nu$ ranges between about 1° to 3°;
$\gamma$ ranges between about 70° to 87°;
$\rho$ ranges between about 2° to 17°; and
$\lambda$ ranges between about 43° to 63°.

4. The can body of claim 1 wherein said bottom closing portion comprises a second frustoconical portion having one end thereof directly attached to the other end of said fifth semi-torroidal portion, said second frustoconical portion being radially inwardly directed with respect to the exterior of said can body and having a length $L_3$ and an angle $\delta$; a sixth semi-torroidal portion having one end thereof directly attached to the other end of said second frustoconical portion, said sixth semi-torroidal portion being concave with respect to the exterior of said can body and having a radius $r_6$ and an angle $\pi$; and a disc portion directly attached to the other end of said sixth semi-torroidal portion, said disc portion having a radius $L_4$ and a height from a plane upon which said can body rests $L_5$.

5. The can body of claim 4 wherein:
$r_1$ ranges between about 0.035 to 0.200 inches (0.089 to 0.508 centimeters);
$r_2$ ranges between about 0.250 to 1.250 inches (0.635 to 3.175 centimeters);
$r_3$ ranges between about 0.020 to 0.080 inches (0.051 to 0.203 centimeters);
$r_4$ ranges between about 0.020 to 0.080 inches (0.051 to 0.203 centimeters);
$r_5$ ranges between about 0.020 to 0.080 inches (0.051 to 0.203 centimeters);
$r_6$ ranges between about 0.100 to 1.000 inches (0.254 to 2.540 centimeters);
$L_1$ ranges between about 0.020 to 0.175 inches (0.051 to 0.445 centimeters);
$L_2$ ranges between about 0.010 to 0.250 inches (0.025 to 0.635 centimeters);
$L_3$ ranges between about 0.100 to 0.500 inches (0.254 to 1.270 centimeters);
$L_4$ ranges between about 0.100 to 0.750 inches (0.254 to 1.950 centimeters);
$L_5$ ranges between about 0.200 to 0.400 inches (0.508 to 1.016 centimeters);
$\alpha$ ranges between about 15° to 30°;
$\beta$ ranges between about 10° to 50°;
$\mu$ ranges between about 10° to 65°;
$\nu$ ranges between about 0° to 10°;
$\gamma$ ranges between about 55° to 88°;
$\rho$ ranges between about 0.5° to 30°;
$\lambda$ ranges between about 30° to 69.5°;
$\delta$ ranges between about 20° to 35°; and
$\pi$ ranges between about 20° to 35°.

6. The can body of claim 5 wherein:
$r_1$ ranges between about 0.075 to 0.125 inches (0.191 to 0.318 centimeters);
$r_2$ ranges between about 0.030 to 0.700 inches (0.762 to 1.799 centimeters);
$r_3$ ranges between about 0.040 to 0.050 inches (0.102 to 0.127 centimeters);
$r_4$ ranges between about 0.020 to 0.060 inches (0.051 to 0.152 centimeters);
$r_5$ ranges between about 0.020 to 0.060 inches (0.051 to 0.152 centimeters);
$r_6$ ranges between about 0.300 to 0.400 inches (0.735 to 1.016 centimeters);
$L_1$ ranges between about 0.060 to 0.120 inches (0.152 to 0.305 centimeters);
$L_2$ ranges between about 0.010 to 0.110 inches (0.025 to 0.279 centimeters);
$L_3$ ranges between about 0.250 to 0.350 inches (0.635 to 0.889 centimeters);
$L_4$ ranges between about 0.300 to 0.500 inches (0.762 to 1.270 centimeters);
$L_5$ ranges between about 0.250 to 0.375 inches (0.635 to 0.953 centimeters);
$\alpha$ ranges between about 20° to 25°;
$\beta$ ranges between about 25° to 40°;
$\mu$ ranges between about 25° to 35°;
$\nu$ ranges between about 1° to 3°;
$\gamma$ ranges between about 70° to 87°;
$\rho$ ranges between about 2° to 17°;
$\lambda$ ranges between about 43° to 63°;
$\delta$ ranges between about 25° to 30°; and
$\pi$ ranges between about 25° to 30°.

7. The can body of claim 1 wherein said bottom closing portion comprises a dome portion directly attached to the other end of said fifth semi-torroidal portion, said dome portion being concave with respect to the exterior of said can body and having a radius $r_7$, an angle $\sigma$ and a height from a plane upon which said can body rests $L_6$.

8. The can body of claim 7 wherein:
$r_1$ ranges between about 0.035 to 0.200 inches (0.089 to 0.508 centimeters);
$r_2$ ranges between about 0.250 to 1.250 inches (0.635 to 3.175 centimeters);
$r_3$ ranges between about 0.020 to 0.080 inches (0.051 to 0.203 centimeters);
$r_4$ ranges between about 0.020 to 0.080 inches (0.051 to 0.203 centimeters);
$r_5$ ranges between about 0.020 to 0.080 inches (0.051 to 0.203 centimeters);
$r_7$ ranges between about 1.500 to 5.000 inches (3.810 to 12.700 centimeters);
$L_1$ ranges between about 0.020 to 0.175 inches (0.051 to 0.445 centimeters);
$L_2$ ranges between about 0.010 to 0.250 inches (0.025 to 0.635 centimeters);
$L_6$ ranges between about 0.250 to 0.500 inches (0.635 to 1.270 centimeters);
$\alpha$ ranges between about 15° to 30°;
$\beta$ ranges between about 10° to 50°;
$\mu$ ranges between about 10° to 65°;
$\nu$ ranges between about 0° to 10°;

$\gamma$ ranges between about 55° to 88°;
$\rho$ ranges between about 0.5° to 30°;
$\lambda$ ranges between about 30° to 69.5°; and
$\sigma$ ranges between about 20° to 50°.

9. The can body of claim 8 wherein:
$r_1$ ranges between about 0.075 to 0.125 inches (0.191 to 0.318 centimeters);
$r_2$ ranges between about 0.030 to 0.700 inches (0.762 to 1.799 centimeters);
$r_3$ ranges between about 0.040 to 0.050 inches (0.102 to 0.127 centimeters);
$r_4$ ranges between about 0.020 to 0.060 inches (0.051 to 0.152 centimeters);
$r_5$ ranges between about 0.020 to 0.060 inches (0.051 to 0.152 centimeters);
$r_7$ ranges between about 2.000 to 3.000 inches (5.080 to 7.620 centimeters);
$L_1$ ranges between about 0.060 to 0.120 inches (0.152 to 0.305 centimeters);
$L_2$ ranges between about 0.010 to 0.110 inches (0.025 to 0.279 centimeters);
$L_6$ ranges between about 0.300 to 0.375 inches (0.762 to 0.953 centimeters);
$\alpha$ ranges between about 20° to 25°;
$\beta$ ranges between about 25° to 40°;
$\mu$ ranges between about 25° to 35°;
$\nu$ ranges between about 1° to 3°;
$\gamma$ ranges between about 70° to 87°;
$\rho$ ranges between about 2° to 17°;
$\lambda$ ranges between about 43° to 63°; and
$\sigma$ ranges between about 25° to 40°.

10. In a metallic can body comprising a sidewall and a bottom closing structure, the improvement wherein said bottom closing structure comprises a first semi-torroidal portion having one end thereof directly attached to said sidewall, said first semi-torroidal portion being convex with respect to the exterior of said can body and having a radius $r_1$ and an angle $\alpha$; a second semi-torroidal portion having one end thereof directly attached to the other end of said first semi-torroidal portion, said second semi-torroidal portion being convex with respect to the exterior of said can body and having a radius $r_2$ and an angle $\beta$, $r_2$ being greater than $r_1$; a third semi-torroidal portion having one end thereof directly attached to the other end of said second semi-torroidal portion, said third semi-torroidal portion being convex with respect to the exterior of said can body and having a radius $r_3$ and an angle $\mu$, $t_3$ being less than $r_2$; a fourth semi-torroidal portion having one end thereof directly attached to the other end of said third semi-torroidal potion, said fourth semi-torroidal portion being concave with respect to the exterior of said can body and having a radius $r_8$ and an angle $\rho$; a ring portion having one end thereof directly attached to the other end of said fourth semi-torroidal portion, said ring portion having a length $L_1$, said length $L_1$ ranging between about 0.020 to 0.175 inches (0.051 to 0.455 centimeters), and said ring portion being radially inwardly directed with respect to the exterior of said can body at an angle $\nu$; a fifth semi-torroidal portion having one end thereof directly attached to the other end of said ring portion, said fifth semi-torroidal portion being convex with respect to the exterior of said can body and having a radius $r_4$ and an angle $\gamma$; a first frustoconical potion having one end thereof directly attached to the other end of said fifth semi-torroidal portion, said first frustoconical portion being radially inwardly directed with respect to the exterior of said can body and having a length $L_2$ and an angle $\rho$; a sixth semi-torroidal portion having one end thereof directly attached to the other end of said first frustoconical portion, said sixth semi-torroidal portion being concave with respect to the exterior of said can body and having a radius $r_5$ and an angle $\lambda$; and a bottom closing portion directly attached to the other end of said sixth semi-torroidal portion.

11. The can body of claim 10 wherein:
$r_1$ ranges between about 0.035 to 0.200 inches (0.089 to 0.508 centimeters);
$r_2$ ranges between about 0.2550 to 1.250 inches (0.635 to 3.175 centimeters);
$r_3$ ranges between about 0.020 to 0.080 inches (0.051 to 0.203 centimeters);
$r_4$ ranges between about 0.020 to 0.080 inches (0.051 to 0.203 centimeters);
$r_5$ ranges between about 0.020 to 0.080 inches (0.051 to 0.203 centimeters);
$r_8$ ranges between about 0.005 to 0.060 inches (0.013 to 0.152 centimeters);
$L_1$ ranges between about 0.020 to 0.175 inches (0.051 to 0.445 centimeters);
$L_2$ ranges between about 0.010 to 0.250 inches (0.025 to 0.635 centimeters);
$\alpha$ ranges between about 15° to 30°;
$\beta$ ranges between about 10° to 50°;
$\mu$ ranges between about 30° to 85°;
$\nu$ ranges between about 0° to 10°;
$\gamma$ ranges between about 55° to 88°;
$\rho$ ranges between about 0.5° to 30°;
$\lambda$ ranges between about 30° to 69.5°; and
$\eta$ ranges between about 10° to 30°.

12. The can body of claim 11 wherein:
$r_1$ ranges between about 0.075 to 0.125 inches (0.191 to 0.318 centimeters);
$r_2$ ranges between about 0.030 to 0.700 inches (0.762 to 1.799 centimeters);
$r_3$ ranges between about 0.040 to 0.050 inches (0.102 to 0.127 centimeters);
$r_4$ ranges between about 0.020 to 0.060 inches (0.051 to 0.152 centimeters);
$r_5$ ranges between about 0.020 to 0.060 inches (0.051 to 0.152 centimeters);
$r_8$ ranges between about 0.005 to 0.020 inches (0.013 to 0.051 centimeters);
$L_1$ ranges between about 0.020 to 0.080 inches (0.051 to 0.203 centimeters);
$L_2$ ranges between about 0.010 to 0.110 inches (0.025 to 0.279 centimeters);
$\alpha$ ranges between about 20° to 25°;
$\beta$ ranges between about 25° to 40°;
$\mu$ ranges between about 45° to 55°;
$\nu$ ranges between about 1° to 3°;
$\gamma$ ranges between about 70° to 87°;
$\rho$ ranges between about 2° to 17°;
$\lambda$ ranges between about 43° to 63°; and
$\eta$ ranges between about 15° to 25°.

13. The can body of claim 10 wherein said bottom closing portion comprises a second frustoconical portion having one end thereof directly attached to the other end of said sixth semi-torroidal portion, said second frustoconical portion being radially inwardly directed with respect to the exterior of said can body and having a length $L_3$ and an angle $\delta$; a seventh semi-torroidal portion having one end thereof directly attached to the other end of said second frustoconical portion, said seventh semi-torroidal portion being concave with respect to the exterior of said can body and having a radius $r_6$ and an angle $\pi$; and a disc portion directly attached to the other end of said seventh semi-torroidal portion, said disc portion having a radius $L_4$ and a height from a plane upon which said can body rests $L_5$.

14. The can body of claim 13 wherein:

$r_1$ ranges between about 0.035 to 0.200 inches (0.089 to 0.508 centimeters);

$r_2$ ranges between about 0.250 to 1.250 inches (0.635 to 3.175 centimeters);

$r_3$ ranges between about 0.020 to 0.080 inches (0.051 to 0.203 centimeters);

$r_4$ ranges between about 0.020 to 0.080 inches (0.051 to 0.203 centimeters);

$r_5$ ranges between about 0.020 to 0.080 inches (0.051 to 0.203 centimeters);

$r_6$ ranges between about 0.100 to 1.000 inches (0.254 to 2.540 centimeters);

$r_8$ ranges between about 0.005 to 0.060 centimeters); (0.013 to 0.152 centimeters);

$L_1$ ranges between about 0.020 to 0.175 inches (0.051 to 0.445 centimeters);

$L_2$ ranges between about 0.010 to 0.250 inches (0.025 to 0.635 centimeters);

$L_3$ ranges between about 0.100 to 0.500 inches (0.254 to 1.270 centimeters);

$L_4$ ranges between about 0.100 to 0.750 inches (0.254 to 1.950 centimeters);

$L_5$ ranges between about 0.200 to 0.400 inches (0.508 to 1.016 centimeters);

$\alpha$ ranges between about 15° to 30°;

$\beta$ ranges between about 10° to 50°;

$\mu$ ranges between about 30° to 85°;

$\nu$ ranges between about 0° to 10°;

$\gamma$ ranges between about 55° to 88°;

$\rho$ ranges between about 0.5° to 30°;

$\lambda$ ranges between about 30° to 69.5°;

$\delta$ ranges between about 20° to 35°;

$\pi$ ranges between about 20° to 35°; and $\eta$ ranges between about 10° to 30°.

15. The can body of claim 14 wherein:

$r_1$ ranges between about 0.075 to 0.125 inches (0.191 to 0.318 centimeters);

$r_2$ ranges between about 0.030 to 0.700 inches (0.762 to 1.799 centimeters);

$r_3$ ranges between about 0.040 to 0.050 inches (0.102 to 0.127 centimeters);

$r_4$ ranges between about 0.020 to 0.060 inches (0.051 to 0.152 centimeters);

$r_5$ ranges between about 0.020 to 0.060 inches (0.051 to 0.152 centimeters);

$r_6$ ranges between about 0.300 to 0.400 inches (0.735 to 1.016 centimeters);

$r_8$ ranges between about 0.005 to 0.020 inches (0.013 to 0.051 centimeters);

$L_1$ ranges between about 0.020 to 0.080 inches (0.051 to 0.203 centimeters);

$L_2$ ranges between about 0.010 to 0.110 inches (0.025 to 0.279 centimeters);

$L_3$ ranges between about 0.250 to 0.350 inches (0.635 to 0.889 centimeters);

$L_4$ ranges between about 0.300 to 0.500 inches (0.762 to 1.270 centimeters);

$L_5$ ranges between about 0.250 to 0.375 inches (0.635 to 0.953 centimeters);

$\alpha$ ranges between about 20° to 25°;

$\beta$ ranges between about 25° to 40°;

$\mu$ ranges between about 45° to 55°;

$\nu$ ranges between about 1° to 3°;

$\gamma$ ranges between about 70° to 87°;

$\rho$ ranges between about 2° to 17°;

$\lambda$ ranges between about 43° to 63°;

$\delta$ ranges between about 25° to 30°;

$\pi$ ranges between about 25° to 30°; and $\eta$ ranges between about 15° to 25°.

16. In a metallic can body comprising a sidewall and a bottom closing structure, the improvement wherein said bottom closing structure comprises a first semi-torroidal portion having one end thereof directly attached to said sidewall, said first semi-torroidal portion being convex with respect to the exterior of said can body and having a radius $r_1$ and an angle $\alpha$; a second semi-torroidal portion having one end thereof directly attached to the other end of said first semi-torroidal portion, said second semi-torroidal portion being convex with respect to the exterior of said can body and having a radius $r_2$ and an angle $\beta$, $r_2$ being greater than $r_1$; a third semi-torroidal portion having one end thereof directly attached to the other end of said second semi-torroidal portion, said third semi-torroidal portion being convex with respect to the exterior of said can body and having a radius $r_3$ and an angle $\mu$, $r_3$ being less than $r_2$; a first frustoconical portion having one end thereof directly attached to the other end of said third semi-torroidal portion, said first frustoconical portion being radially inwardly directed with respect to the exterior of said can body and having a length $L_7$ and an angle l; a fourth semi-torroidal portion having one end thereof directly attached to the other end of said first frustoconical portion, said fourth semi-torroidal portion being concave with respect to the exterior of said can body and having a radius $r_8$ and an angle $\eta$; a ring portion having one end thereof directly attached to the other end of said fourth semi-torroidal portion, said ring portion having a length $L_1$, said length $L_1$ ranging between about 0.020 to 0.175 inches (0.051 to 0.445 centimeters), and said ring portion being radially inwardly directed with respect to the exterior of said can body at an angle $\upsilon$; a fifth semi-torroidal portion having one end thereof directly attached to the other end of said ring portion, said fifth semi-torroidal other end of said ring portion, said fifth semi-torroidal portion being convex with respect to the exterior of said can body and having a radius $r_4$ and an angle $\gamma$; a second frustoconical portion having one end thereof directly attached to the other end of said fifth semi-torroidal portion, said second frustoconical portion being radially inwardly directed with respect to the exterior of said can body and having a length $L_2$ and an angle $\rho$; a sixth semi-torroidal portion having one end thereof directly attached to the other end of said second frustoconical portion, said sixth semi-torroidal portion being concave witth respect to the exterior of said can body and having a radius $r_5$ and an angle $\lambda$; and a bottom closing portion directly attached to the other end of said sixth semi-torroidal portion.

17. The can body of claim 16 wherein:

$r_1$ ranges between about 0.035 to 0.200 inches (0.089 to 0.508 centimeters);

$r_2$ ranges between about 0.250 to 1.250 inches (0.635 to 3.175 centimeters);

$r_3$ ranges between about 0.020 to 0.080 inches (0.051 to 0.203 centimeters);

$r_4$ ranges between about 0.020 to 0.080 inches (0.051 to 0.203 centimeters);

$r_5$ ranges between about 0.020 to 0.080 inches (0.051 to 0.203 centimeters);

$r_8$ ranges between about 0.005 to 0.060 inches (0.013 to 0.152 centimeters);
$L_1$ ranges between about 0.020 to 0.175 inches (0.051 to 0.445 centimeters);
$L_2$ ranges between about 0.010 to 0.250 inches (0.025 to 0.635 centimeters);
$L_7$ is up to about 0.100 inches (0.254 centimeters);
$\alpha$ ranges between about 15° to 30°;
$\beta$ ranges between about 10° to 50°;
$\mu$ ranges between about 30° to 85°;
$\nu$ ranges between about 0° to 10°;
$\gamma$ ranges between about 55° to 88°;
$\rho$ ranges between about 0.5° to 30°;
$\lambda$ ranges between about 30° to 69.5°;
l ranges between about 5° to 50°; and
$\eta$ ranges between about 10° to 30°.

18. The can body of claim 17 wherein:
$r_1$ ranges between about 0.075 to 0.125 inches (0.191 to 0.318 centimeters);
$r_2$ ranges between about 0.030 to 0.700 inches (0.762 to 1.799 centimeters);
$r_3$ ranges between about 0.040 to 0.050 inches (0.102 to 0.127 centimeters);
$r_4$ ranges between about 0.020 to 0.060 inches (0.051 to 0.152 centimeters);
$r_5$ ranges between about 0.020 to 0.060 inches (0.051 to 0.152 centimeters);
$r_8$ ranges between about 0.005 to 0.020 inches (0.013 to 0.051 centimeters);
$L_1$ ranges between about 0.020 to 0.080 inches (0.051 to 0.203 centimeters);
$L_2$ ranges between about 0.010 to 0.110 inches (0.025 to 0.279 centimeters);
$L_7$ is up to about 0.060 inches (0.152 centimeters);
$\alpha$ ranges between about 20° to 25°;
$\beta$ ranges between about 25° to 40°;
$\mu$ ranges between about 45° to 55°;
$\nu$ ranges between about 1° to 3°;
$\gamma$ ranges between about 70° to 87°;
$\rho$ ranges between about 2° to 17°;
$\lambda$ ranges between about 43° to 63°;
l ranges between about 10° to 30°; and
$\eta$ ranges between about 15° to 25°.

19. The can body of claim 16 wherein said bottom closing portion comprises a third frustonical portion having one end thereof directly attached to the other end of said sixth semi-torroidal portion, said third frustoconical portion being radially inwardly directly with respect to the exterior of said can body and having a length $L_3$ and an angle $\delta$; a seventh semi-torroidal portion having one end thereof directly attached to the other end of said third frustoconical portion, said seventh semi-torroidal portion being concave with respect to the exterior of said can body and having a radius $r_6$ and an angle $\pi$; and a disc portion directly attached to the other end of said seventh semi-torroidal portion, said disc portion having a radius $L_4$ and a height from a plane upon which said can body rests $L_5$.

20. The can body of claim 19 wherein:
$r_1$ ranges between about 0.035 to 0.200 inches (0.089 to 0.508 centimeters);
$r_2$ ranges between about 0.250 to 1.250 inches (0.635 to 3.175 centimeters);
$r_3$ ranges between about 0.020 to 0.080 inches (0.051 to 0.203 centimeters);
$r_4$ ranges between about 0.020 to 0.080 inches (0.051 to 0.203 centimeters);
$r_5$ ranges between about 0.020 to 0.080 inches (0.051 to 0.203 centimeters);
$r_6$ ranges between about 0.100 to 1.000 inches (0.254 to 2.540 centimeters);
$r_8$ ranges between about 0.005 to 0.060 inches (0.013 to 0.152 centimeters);
$L_1$ ranges between about 0.020 to 0.175 inches (0.051 to 0.445 centimeters);
$L_2$ ranges between about 0.010 to 0.250 inches (0.250 to 0.635 centimeters);
$L_3$ ranges between about 0.100 to 0.500 inches (0.254 to 1.270 centimeters);
$L_4$ ranges between about 0.100 to 0.750 inches (0.254 to 1.950 centimeters);
$L_5$ ranges between about 0.200 to 0.400 inches (0.508 to 1.016 centimeters);
$L_7$ is up to about 0.100 inches (0.254 centimeters);
$\alpha$ ranges between about 15° to 30°;
$\beta$ ranges between about 10° to 50°;
$\mu$ ranges between about 30° to 85°;
$\nu$ ranges between about 0° to 10°;
$\gamma$ ranges between about 55° to 88°;
$\rho$ ranges between about 0.5° to 30°;
$\lambda$ ranges between about 30° to 69.5°;
$\delta$ ranges between about 20° to 35°;
$\pi$ ranges between about 20° to 35°;
l ranges between about 5° to 50°; and
$\eta$ ranges between about 10° to 30°.

21. The can body of claim 20 wherein:
$r_1$ ranges between about 0.075 to 0.125 inches (0.191 to 0.318 centimeters);
$r_2$ ranges between about 0.030 to 0.700 inches (0.762 to 1.799 centimeters);
$r_3$ ranges between about 0.040 to 0.050 inches (0.102 to 0.127 centimeters);
$r_4$ ranges between about 0.020 to 0.060 inches (0.051 to 0.152 centimeters);
$r_5$ ranges between about 0.020 to 0.060 inches (0.051 to 0.152 centimeters);
$r_6$ ranges between about 0.300 to 0.400 inches (0.735 to 1.016 centimeters);
$r_8$ ranges between about 0.005 to 0.020 inches (0.013 to 0.051 centimeters);
$L_1$ ranges between about 0.020 to 0.080 inches (0.051 to 0.203 centimeters);
$L_2$ ranges between about 0.010 to 0.110 inches (0.025 to 0.279 centimeters);
$L_3$ ranges between about 0.250 to 0.350 inches (0.635 to 0.889 centimeters);
$L_4$ ranges between about 0.300 to 0.500 inches (0.762 to 1.270 centimeters);
$L_5$ ranges between about 0.250 to 0.375 inches (0.635 to 0.953 centimeters);
$L_7$ is up to about 0.060 inches (0.152 centimeters);
$\alpha$ ranges between about 20° to 25°;
$\beta$ ranges between about 25° to 40°;
$\mu$ ranges between about 45° to 55°;
$\nu$ ranges between about 1° to 3°;
$\gamma$ ranges between about 70° to 87°;
$\rho$ ranges between about 2° to 17°;
$\lambda$ ranges between about 43° to 63°;
$\delta$ ranges between about 25° to 30°;
$\pi$ ranges between about 25° to 30°;
l ranges between about 10° to 30°; and
$\eta$ ranges between about 15° to 25°.

22. The can body of claim 16 wherein said bottom closing portion comprises of a dome portion directly attached to the other end of said sixth semi-torroidal portion, said dome portion being concave with respect to the exterior of said can body and having a radius $r_7$, an angle $\sigma$ and a height from a plane upon which said can body rests $L_6$.

23. The can body of claim 22 wherein:

$r_1$ ranges between about 0.035 to 0.200 inches (0.089 to 0.508 centimeters);

$r_2$ ranges between about 0.250 to 1.250 inches (0.635 to 3.175 centimeters);

$r_3$ ranges between about 0.020 to 0.080 inches (0.051 to 0.203 centimeters);

$r_4$ ranges between about 0.020 to 0.080 inches (0.051 to 0.203 centimeters);

$r_5$ ranges between about 0.020 to 0.080 inches (0.051 to 0.203 centimeters);

$r_7$ ranges between about 1.500 to 5.000 inches (3.810 to 12.700 centimeters);

$r_8$ ranges between about 0.005 to 0.060 inches (0.013 to 0.152 centimeters);

$L_1$ ranges between about 0.020 to 0.175 inches (0.051 to 0.445 centimeters);

$L_2$ ranges between about 0.010 to 0.250 inches (0.025 to 0.635 centimeters);

$L_6$ ranges between about 0.250 to 0.500 inches (0.635 to 1.270 centimeters);

$L_7$ is up to about 0.100 inches (0.254 centimeters);

$\alpha$ ranges between about 15° to 30°;

$\beta$ ranges between about 10° to 50°;

$\mu$ ranges between about 30° to 85°;

$\nu$ ranges between about 0° to 10°;

$\gamma$ ranges between about 55° to 88°;

$\rho$ ranges between about 0.5° to 30°;

$\lambda$ ranges between about 30° to 69.5°;

$\sigma$ ranges between about 20° to 50°;

l ranges between about 5° to 50°; and $\eta$ ranges between about 10° to 30°.

24. The can body of claim 23 wherein:

$r_1$ ranges between about 0.075 to 0.125 inches (0.191 to 0.318 centimeters);

$r_2$ ranges between about 0.030 to 0.700 inches (0.762 to 1.799 centimeters);

$r_3$ ranges between about 0.040 to 0.050 inches (0.102 to 0.127 centimeters);

$r_4$ ranges between about 0.020 to 0.060 inches (0.051 to 0.152 centimeters);

$r_5$ ranges between about 0.020 to 0.060 inches (0.051 to 0.152 centimeters);

$r_7$ ranges between about 2.000 to 3.000 inches (5.080 to 7.620 centimeters);

$r_8$ ranges between about 0.005 to 0.020 inches (0.013 to 0.051 centimeters);

$L_1$ ranges between about 0.020 to 0.080 inches (0.051 to 0.203 centimeters);

$L_2$ ranges between about 0.010 to 0.110 inches (0.025 to 0.279 centimeters);

$L_6$ ranges between about 0.300 to 0.375 inches (0.762 to 0.953 centimeters);

$L_7$ is up to about 0.060 inches (0.152 centimeters);

$\alpha$ ranges between about 20° to 25°;

$\beta$ ranges between about 25° to 40°;

$\mu$ ranges between about 45° to 55°;

$\nu$ ranges between about 1° to 3°;

$\gamma$ ranges between about 70° to 87°;

$\rho$ ranges between about 2° to 17°;

$\lambda$ ranges between about 43° to 63°;

$\sigma$ ranges between about 25° to 40°;

l ranges between about 10° to 30°; and $\eta$ ranges between about 15° to 25°.

25. The can body of claim 16 wherein said bottom closing portion comprises a dome portion directly attached to the other end of said sixth semi-torroidal portion, said dome portion being concave with respect to the exterior of said can body and having a radius $r_7$, an angle $\sigma$, and a height from a plane upon which said can body rests $L_6$.

26. The can body of claim 25 wherein:

$r_1$ ranges between about 0.035 to 0.200 inches (0.089 to 0.508 centimeters);

$r_2$ ranges between about 0.250 to 1.250 inches (0.635 to 3.175 centimeters);

$r_3$ ranges between about 0.020 to 0.080 inches (0.051 to 0.203 centimeters);

$r_4$ ranges between about 0.020 to 0.080 inches (0.051 to 0.203 centimeters);

$r_5$ ranges between about 0.020 to 0.080 inches (0.051 to 0.203 centimeters);

$r_7$ ranges between about 1.500 to 5.000 inches (3.810 to 12.700 centimeters;

$r_8$ ranges between about 0.005 to 0.060 inches (0.013 to 0.152 centimeters;

$L_1$ ranges between about 0.020 to 0.175 inches (0.051 to 0.445 centimeters;

$L_2$ ranges between about 0.010 to 0.250 inches (0.025 to 0.635 centimeters;

$L_6$ ranges between about 0.250 to 0.500 inches (0.635 to 1.270 centimeters);

$\alpha$ ranges between about 15° to 30°;

$\beta$ ranges between about 10° to 50°;

$\mu$ ranges between about 30° to 85°;

$\nu$ ranges between about 0° to 10°;

$\gamma$ ranges between about 55° to 88°;

$\rho$ ranges between about 0.5° to 30°;

$\lambda$ ranges between about 30° to 69.5°;

$\sigma$ ranges between about 20° to 50°; and $\eta$ ranges between about 10° to 30°.

27. The can body of claim 26 wherein:

$r_1$ ranges between about 0.075 to 0.125 inches (0.191 to 0.318 centimeters);

$r_2$ ranges between about 0.030 to 0.700 inches (0.762 to 1.799 centimeters);

$r_3$ ranges between about 0.040 to 0.050 inches (0.102 to 0.127 centimeters);

$r_4$ ranges between about 0.020 to 0.060 inches (0.051 to 0.152 centimeters);

$r_5$ ranges between about 0.020 to 0.060 inches (0.051 to 0.152 centimeters);

$r_7$ ranges between about 2.000 to 3.000 inches (5.080 to 7.620 centimeters);

$r_8$ ranges between about 0.005 to 0.020 inches (0.013 to 0.051 centimeters);

$L_1$ ranges between about 0.020 to 0.080 inches (0.051 to 0.203 centimeters);

$L_2$ ranges between about 0.010 to 0.110 inches (0.025 to 0.279 centimeters);

$L_6$ ranges between about 0.300 to 0.375 inches (0.762 to 0.953 centimeters);

$\alpha$ ranges between about 20° to 25°;

$\beta$ ranges between about 25° to 40°;

$\mu$ ranges between about 45° to 55°;

$\nu$ ranges between about 1° to 3°;

$\gamma$ ranges between about 70° to 87°;

$\rho$ ranges between about 2° to 17°;

$\lambda$ ranges between about 43° to 63°;

$\sigma$ ranges between about 25° to 40°; and $\eta$ ranges between about 15° to 25°.

* * * * *